US007866042B2

(12) United States Patent
Kolb

(10) Patent No.: US 7,866,042 B2
(45) Date of Patent: Jan. 11, 2011

(54) METHOD FOR PRODUCING A SPLIT LOUVER HEAT EXCHANGER FIN

(75) Inventor: John A. Kolb, Old Lyme, CT (US)

(73) Assignee: Centrum Equities Acquisition, LLC, Nashville, TN (US)

( * ) Notice: Subject to any disclaimer, the term of this patent is extended or adjusted under 35 U.S.C. 154(b) by 1028 days.

(21) Appl. No.: 11/622,512

(22) Filed: Jan. 12, 2007

(65) Prior Publication Data

US 2008/0169091 A1 Jul. 17, 2008

(51) Int. Cl.

| | |
|---|---|
| ***B21D 13/00*** | (2006.01) |
| ***B21D 53/02*** | (2006.01) |
| ***B23P 15/16*** | (2006.01) |
| ***F28D 1/04*** | (2006.01) |

(52) U.S. Cl. ..... 29/890.03; 29/896.6; 72/186; 72/187; 165/151; 165/152

(58) Field of Classification Search ..... 29/890.03, 29/896.6; 72/186, 187; 165/151, 152
See application file for complete search history.

(56) References Cited

U.S. PATENT DOCUMENTS

| | | | | |
|---|---|---|---|---|
| 2,410,140 | A | 10/1946 | Young | |
| 5,361,829 | A | 11/1994 | Kreutzer et al. | |
| 5,669,438 | A | 9/1997 | Baeles et al. | |
| 5,752,567 | A | 5/1998 | Obosu | |
| 6,170,566 | B1 | 1/2001 | Blumel et al. | |
| 6,594,896 | B2 * | 7/2003 | Morihira et al. | 29/890.03 |
| 6,672,376 | B2 | 1/2004 | Shembekar et al. | |
| 6,918,432 | B2 | 7/2005 | Ozaki | |
| 2003/0075307 | A1 | 4/2003 | Stoynoff et al. | |
| 2007/0246202 | A1 * | 10/2007 | Yu | 165/152 |

* cited by examiner

*Primary Examiner*—David P Bryant
*Assistant Examiner*—Alexander P Taousakis
(74) *Attorney, Agent, or Firm*—DeLio & Peterson, LLC; Peter W. Peterson

(57) ABSTRACT

A method of manufacturing serpentine fins for assembly between tubes in a heat exchanger core. The method includes providing a flat metal strip and forming in the strip, multiple rows of split louvers. Each row of split louvers has louvers formed in pairs of adjacent, spaced louver banks extending across the width of the strip. Each row includes ribs formed in the strip parallel to the louver openings and extending across the pair of louver banks. The metal strip has unformed portions extending across the strip width between rows of split louvers for forming folds across the width of the strip. After forming the rows of split louvers, pressure is applied to the strip to cause the flat strip to buckle along the unformed portions forming folds in the strip resulting in the serpentine fin. Preferably, the strip has ribs formed both in the center portion and along the edges.

18 Claims, 6 Drawing Sheets

METHOD FOR PRODUCING A SPLIT LOUVER HEAT EXCHANGER FIN

BACKGROUND OF THE INVENTION

1. Field of the Invention

The present invention relates to the manufacture of heat exchangers and, in particular, to the manufacture of a split louver serpentine fin for heat exchanger cores.

2. Description of Related Art

In the manufacturing of cores for motor vehicle radiators, charge air coolers and other air-cooled heat exchangers, fins formed from thin gauge metal strip such as copper or aluminum are placed between and in contact with the tubes which carry the fluid to be cooled. The heat exchanger core tubes typically extend between the manifolds, or the inlet and outlet tanks, of the heat exchanger. The fins are the chief heat exchange medium between the coolant and the ambient air. The ability of the fins to transfer heat from the tubes to the air passing over the fins greatly relies on the design of the fins, with some including dimples or protrusions to aid in the heat transfer. To increase the heat transfer rate even further, louvers have been incorporated into the fins. The louvers turbulate the air in a manner which has been found to increase the efficiency of the radiator. The louver configuration may be so-called full louvers, where each louver in the row extends over essentially the entire distance between the tubes, or split louvers, where two side-by-side banks of louvers are employed in the row, so that each of the two louvers extends over less than half of the distance between each tube.

Many heat exchangers employ serpentine fins, in which a flat metal strip is folded into convolutions to create the multiple fins between spaced tubes. When louvers are incorporated into the fins, the structural integrity of the fin is compromised, particularly where serpentine fins are used. A process known as hard-tool forming is typically used in forming the serpentine fin, wherein the louvers are formed with a pair of dies which have a star configuration for forming the convolutions at the same time. The complexity of the dies and machinery for performing the formation of the fins make the process costly. There has been progress made in providing low-cost fin rolls for making ordinary louvered fins by a process known as air-forming. In the air-forming process, the rolls only need to have the die formation for the louvers, and the star shape of the roll may be eliminated. As the rolls push out the strip of metal having the cut and formed full louvers, backpressure is applied at different locations to the metal strip to force the metal to buckle, create the convolutions in the strip of metal, and form the finished serpentine configuration in the desired fin per inch density. However, the air-forming process often produces convolutions that are more random in placement with respect to the rows of louvers compared to the use of hard tooling. The use of the air-forming process has been found to distort the full louvers, change the angle of the louvers, and sometimes close the louver opening altogether. Because of the difficulties in forming full louver serpentine fins, it is believed that the air forming process has not been used for split louvers (which offer better heat transfer performance), and that it has been necessary to make split louver serpentine fins solely with a hard tooling process.

SUMMARY OF THE INVENTION

Bearing in mind the problems and deficiencies of the prior art, it is therefore an object of the present invention to provide an improved method for manufacturing louvered serpentine fins using an air-forming process.

It is another object of the present invention to provide a method for manufacturing split louvered serpentine fins which is cost-effective, yet produces a quality fin.

A further object of the invention is to provide a method for manufacturing louvered serpentine fins with a louver which does not decrease the structural integrity of the fin.

It is yet another object of the present invention to provide a method for manufacturing split louvered serpentine fins which results in fins having consistently high efficiency and heat transfer rates.

Still other objects and advantages of the invention will in part be obvious and will in part be apparent from the specification.

The above and other objects, which will be apparent to those skilled in the art, are achieved in the present invention which is directed to a method of manufacturing serpentine fins for assembly between tubes in a heat exchanger core. The method includes providing a flat metal strip for making heat exchanger fins, the strip having a width between opposite strip edges and a length greater than the width and forming in the strip, while the strip is substantially flat, multiple rows of split louvers. Each row of split louvers has louvers with openings extending in the direction of the strip length and formed in a pair of adjacent spaced louver banks extending at least a portion across of the width of the strip. Each row includes ribs formed in the strip substantially parallel to the louver openings and extending across the pair of louver banks. The metal strip has unformed portions extending across the strip width, between rows of split louvers and ribs, for forming folds across the width of the strip. After forming the rows of split louvers, an initial pressure is applied to the metal strip to cause the substantially flat strip to buckle in the unformed portions and begin to form folds in the strip. At least one row of split louvers is between adjacent folds along the length of the strip. Thereafter further pressure is applied to the metal strip to complete formation of the folds of the strip to form the serpentine fin. The distance between the adjacent folds conforms to the desired spacing distance between the heat exchanger core tubes.

The ribs formed in the strip may be along the edges of the strip or the ribs may be in a center portion between the edges. Preferably, the strip will have ribs formed both in the center portion and along the edges.

The ribs are elongated, plastically deformed sections and may include at least one angled leg connected to an adjacent louver. The ribs have a height extending from a plane of the metal strip and the ratio of the height to the thickness of the metal strip is preferably between about 4 and 5.

The louvers have ends adjacent the unformed portions of the metal strip and after applying the further pressure to the metal strip, the distance between the louver ends and the folds at the unformed portions may be substantially equal. The louvers are formed at an angle to a plane of the metal strip and the louver angle is preferably between about 26 degrees and about 32 degrees.

During the formation of the split louvers and the folding of the strip, the strip may be continually moving such that the initial pressure is a backpressure applied by contacting the strip at a first location and such that the further pressure is a further backpressure applied by contacting the strip at a second location downstream of the first location with respect to strip movement.

In another aspect the invention is directed to a serpentine fin for assembly between tubes in a heat exchanger core. The serpentine fin comprises a metal strip having a width between opposite strip edges and a length greater than the width and having multiple rows of split louvers. Each row of split louvers comprises louvers having openings extending in the direction of the strip length and formed in a pair of adjacent, spaced louver banks extending at least a portion across of the width of the strip. The strip includes ribs formed in the strip substantially parallel to the louver openings adjacent the strip edges and in a center portion of the strip between the strip edges and extending across the pair of louver banks. The metal strip has unformed portions extending across the strip width between rows of strip louvers and ribs, wherein the strip has folds along the unformed portions extending across the strip width such that the strip forms a serpentine shape with at least one row of split louvers between adjacent folds. The folds are adapted to contact the tubes in the heat exchanger core.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
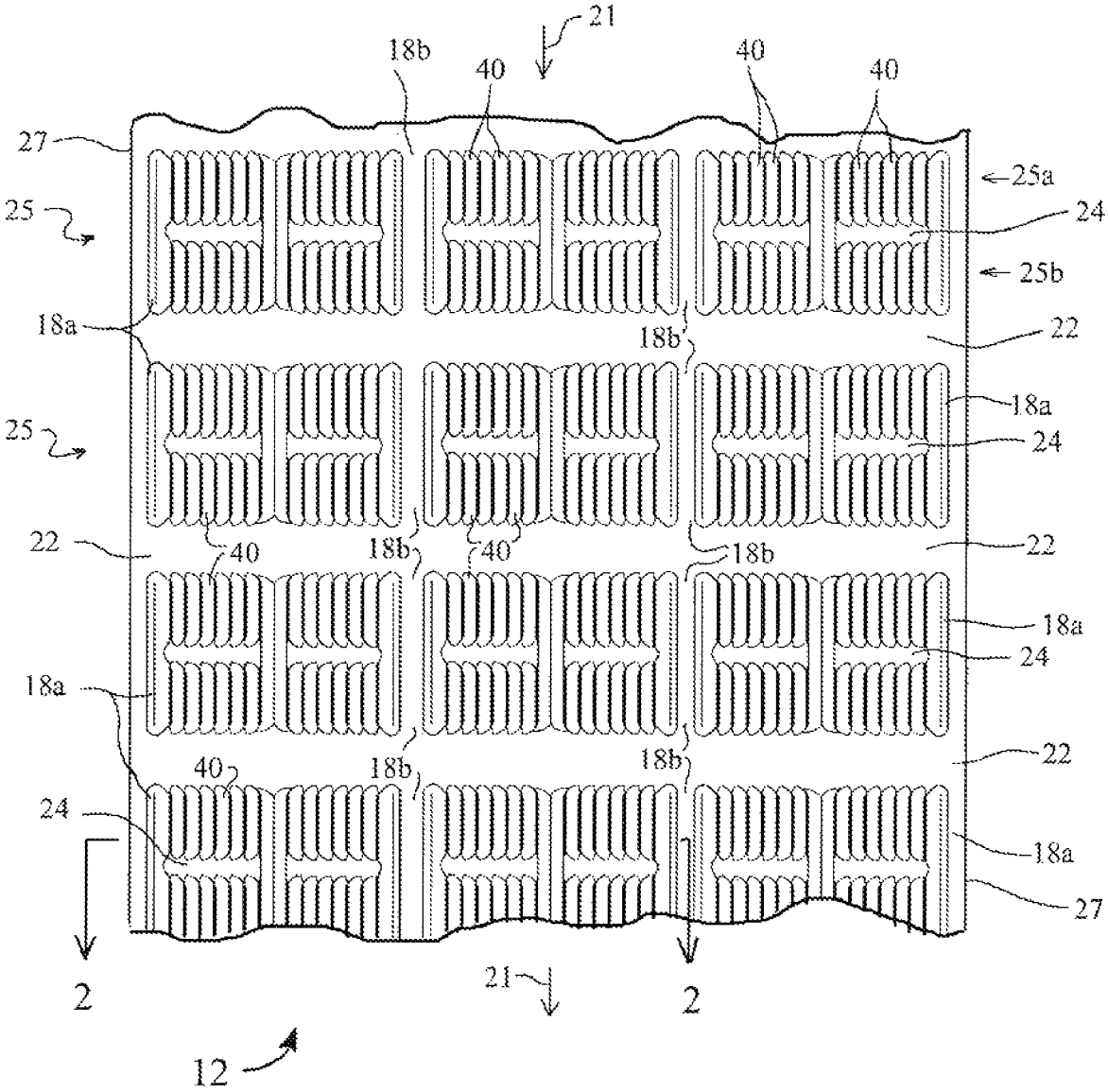
FIG. 1 is a top plan view of a metal strip having split louvers formed therein in accordance with the present invention.
Figure 2:
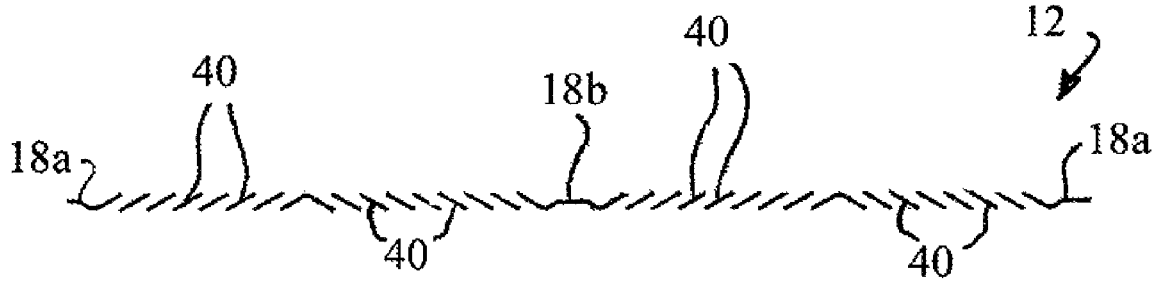
FIG. 2 is a cross sectional view of the split louvers of FIG. 1 along line 2-2.

In describing the preferred embodiment of the present invention, reference will be made herein to FIGS. 1-11 of the drawings in which like numerals refer to like features of the invention.

FIGS. 1-4 depict the preferred split louver fin configuration formed in a flat metal strip in accordance with the present invention, prior to forming the serpentine convolutions. A length of metal strip 12 of aluminum or preferably copper has split louvers 40 extending in rows 25 across the width of the strip, ribs 18*a* and 18*b* formed adjacent the louvers within the rows, and unformed portions 22 extending across the strip width between rows of the louvers. The louvers are formed by cutting the strip and twisting and plastically deforming the cut portions. The opposite ends of each of the louvers maintain connection with the remaining metal strip by a twist portion. Each row 25 of split louvers is made up of a pair of banks 25*a*, 25*b* of individual louvers 40, which are separated from each other by unformed portion 24 extending in the direction of the strip width. The adjacent, spaced louver banks 25*a*, 25*b* extend across at least a portion of the width of the strip 12, and preferably extend across substantially all of the strip width. The louvers 40, the openings between the louvers, and ribs 18*a*, 18*b* extend in the direction of the strip length 21.

Figure 3:
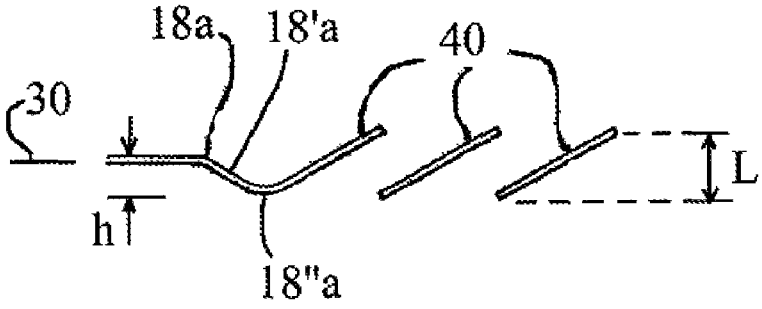
FIG. 3 is a close up view of the portion of FIG. 2 in the vicinity of the end rib in the split louvers.
Figure 4:
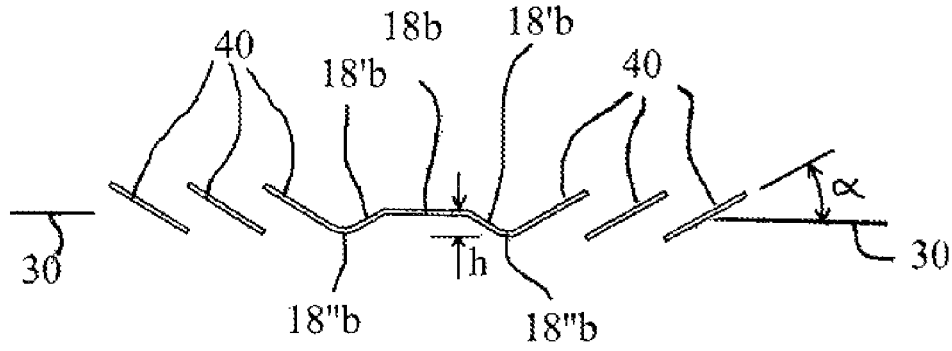
FIG. 4 is a close up view of the portion of FIG. 2 in the vicinity of the center rib in the split louvers.

Ribs 18*a*, 18*b* are plastically deformed in the strip substantially parallel to the louver openings in the direction of the strip length and extend substantially completely across the pair of louver banks 25*a*, 25*b*, including across the unformed strip portion 24 between the louver banks. End ribs 18*a* are located near the strip edges 27 and center ribs 18*b* are located in center portions of the strip between the strip edges. Ribs 18*a*, 18*b* extend across the pair of louver banks, but not beyond the ends of the louvers into the unformed sections 22 separating the rows of louvers. End ribs 18*a* shown in the detailed view of FIG. 3 have plastically deformed portions and include one angled leg 18*a* extending at an angle downward from the plane 30 of the undeformed metal strip and a bent portion 18"a that connects to the adjacent louver 40. The end ribs are ultimately positioned, after assembly of the fin in the core, near the upstream and downstream ends of the fin relative to the direction of cooling airflow. Center ribs 18*b* shown in the detailed view of FIG. 4 also have plastically deformed portions with angled legs 18'*b* extending at an angle downward from an undeformed metal strip portion in plane 30 and bent portions 18"*b* that connect to the adjacent split louvers 40. The number and spacing of center ribs 18*b* among the louvers in each row may be determined according to the strength requirements of the strip during air forming, as will be described in more detail below. As shown in FIGS. 3 and 4, each split louver 40 has a total height L and is angled at an angle $\alpha$ from the neutral plane 30 of the undeformed metal strip 12. In one preferred embodiment, the strip and louvers have a thickness of about 0.0022 in. (0.056 mm), and the louvers have angle $\alpha$ of about 30° and height L of about 0.023 in. (0.58 mm). The ribs have a height a distance h in one direction from the neutral plane of about 0.0104 in. (0.26 mm). The ratio of h/s is about 4.7, and signifies that the height of the rib is about 4.7 times the thickness of the fin material.

Figure 5:
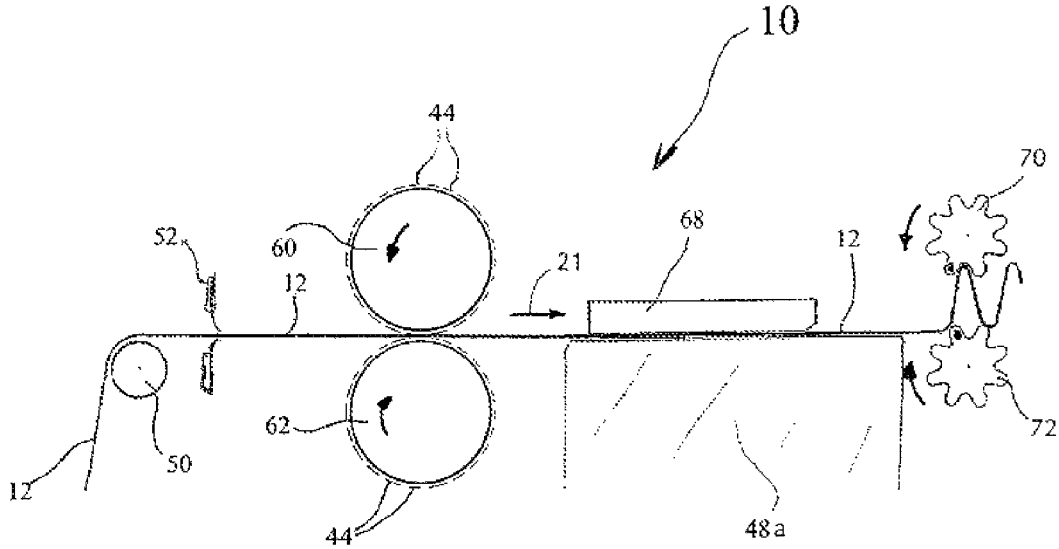
FIGS. 5-8 are side elevational views of an air forming machine showing the forming of the louvers and ribs by fin rolls, and the progression of the forming of the convolutions of the serpentine strip.

The process of forming the serpentine split louver fins of the present invention is shown in FIGS. 5-8, and begins by providing a coil of unformed metal strip for continuous feeding through a modified prior art air forming machine 10. As shown in FIG. 5, the air forming machine 10 comprises a front roller 50 which guides the metal strip through a pair of opposing wiping pads 52, one on each side of the metal strip, for cleaning any contamination thereon. A pair of counter rotating fin rolls 60, 62 having a cylindrical shape are positioned downstream from the wiping pads with respect to the metal strip. Fin rolls 60, 62 are sufficiently close to one another to exert a compression force on the surface of the moving metal strip in a direction normal to the strip plane, as well as move the strip continuously in direction 21. Unlike prior air forming machines, the surfaces of each of the fin rolls 60, 62 have a plurality of meshing cutter blades and tool patterns 44 which cut and form the split louvers 40 and ribs 18*a*, 18*b* in the metal strip, to the configuration shown in FIGS. 1-4.

Figure 6:
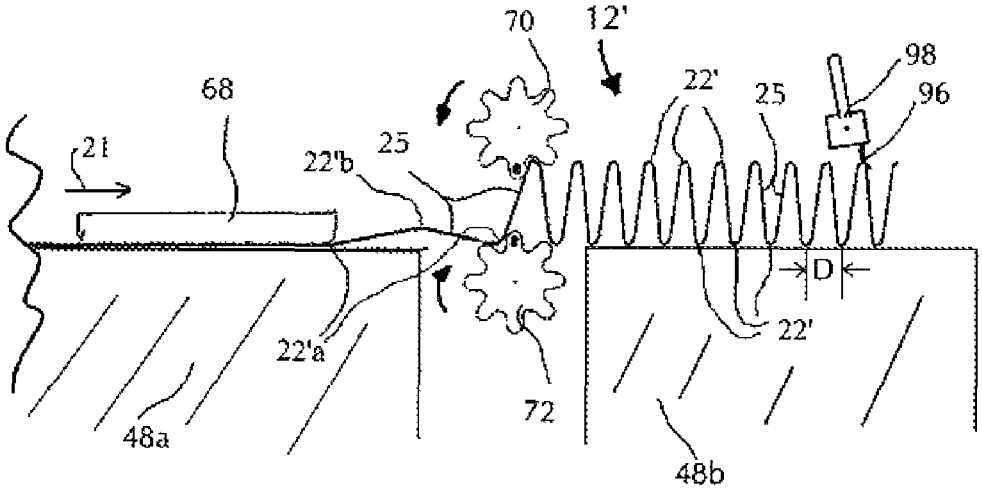

As the fin rolls 60, 62 push the metal strip downstream 21, the formed metal strip passes between a backing plate 68 and a first base portion 48*a*, which contact the strip to maintain it in a substantially flat position. The metal strip 12 continues to move downstream from the backing plate and into contact with a pair of counter rotating folding shafts 70, 72 respectively positioned above and below the strip plane. Each folding shaft 70, 72 has a plurality of arms extending outward from the axis of rotation, and the ends of the arms are parallel to the strip width. As shown in FIG. 6, the metal strip contacts arms of the rotating lower folding shaft 72 and upper folding shaft, which arms provide an initial backpressure in a direction opposite to the motion of the strip in direction 21. In particular, the metal strip contacts one of the lower folding shaft 72 arms forcing an unformed portion 22 into a radius formed between shaft arms, creating the initial backpressure on the metal strip between the backing plate 68 and the lower folding shaft 72. As the backpressure is applied, strip 12 begins to buckle along a first unformed portion 22 between backing plate 68 and lower folding shaft 72. The unformed portions 22 of the metal strip have the least amount of structural integrity against forces which tend to make the metal strip bend across its width, while the split louvers and the ribs inhibit buckling and folding in the louver rows. The term air forming refers to the fact that the folds are made in a controlled fashion in air without the necessity to use male and female tool sections conforming to the desired degree of folding.

Figure 7:
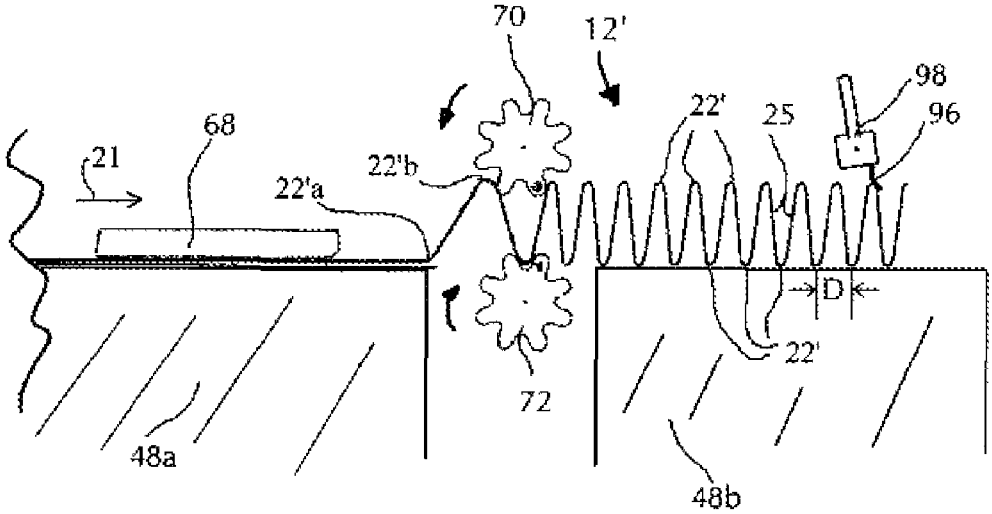
Figure 8:
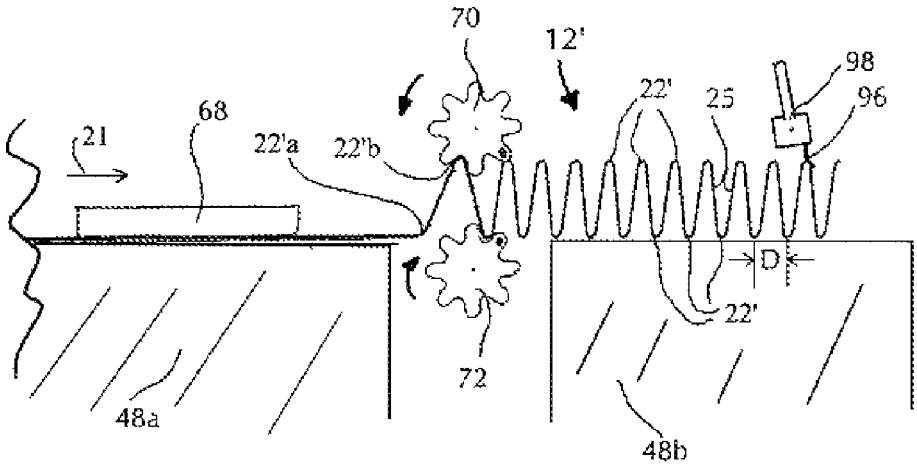

FIG. 6 shows the result of the initial backpressure causing the metal strip to buckle along the unformed portions 22'*a* creating a fold in one direction, and to buckle along the unformed portion 22'*b* creating a fold in the opposite direction. As the metal strip moves from backing plate 68 to folding shafts 70, 72, it continues to buckle, and additional folds 22'*a*, 22'*b* are created along the adjacent unformed portions 22 to create the folds or convolutions in the strip between each row 25 of split louvers. The fold angles continue to increase as the strip approaches and passes between the folding shafts, as shown in FIGS. 7 and 8, which show the progression of the strip folding.

A further backpressure is applied to the convoluted strip by a gathering station downstream of the folding shafts, again in a direction opposite to the strip movement direction 21. As shown in FIGS. 6, 7, and 8, this gathering station, has fingers 96, preferably in the form of a metal brush, mounted on an adjustable lever 98 which sequentially contact the upper folds 22' of the convoluted strip as it passes in direction 21. The force of fingers 96 urges the convoluted strip against a second base portion 48*b*, and may be adjusted to apply sufficient backpressure to create the desired density of strip convolutions, i.e., the number of straight portions containing split louver fins 25 (between folds) in a distance D of formed serpentine fin strip 12'. This fin strip density is typically described as number of fins per inch. Increased backpressure at the gathering station produces a higher fin density, while lower backpressure at the gathering station results in a lower fin density. The air forming process continues until the final fold angle is obtained at folded unformed portions 22' to form the desired number of folds into a length of fin strip 12'. The fin strip 12' is subsequently cut to create the desired number of fins corresponding to the length of the tubes in the heat exchanger core.

Figure 9:
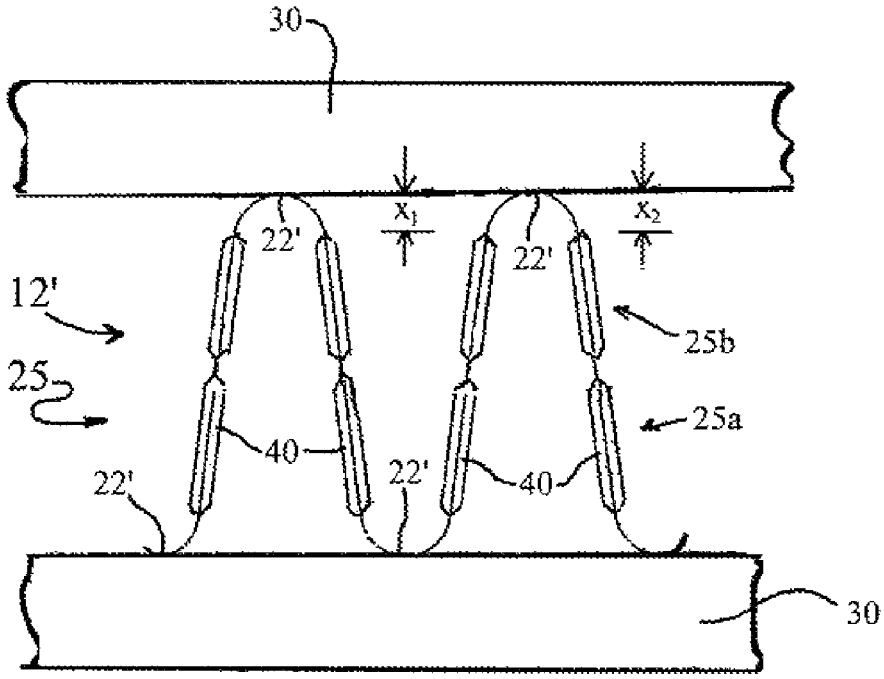
FIG. 9 is a side view of a portion of a heat exchanger core showing the serpentine split louver fin of the present invention between heat exchanger core tubes.
Figure 10:
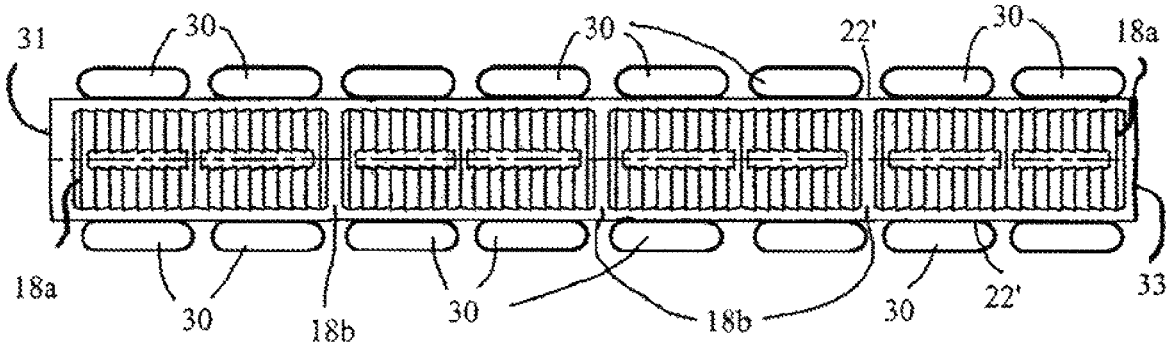
FIG. 10 is an end view of a heat exchanger core showing the serpentine split louver fin of the present invention between heat exchanger core tubes.
Figure 11:
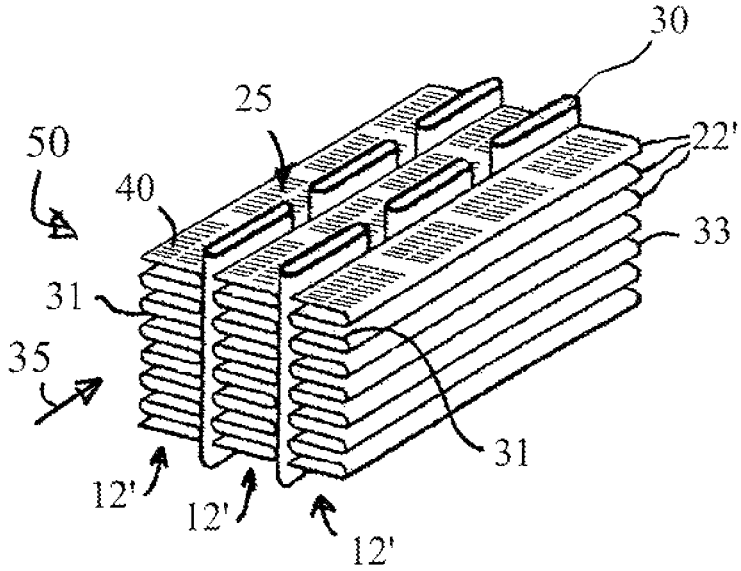
FIG. 11 is a perspective view of a portion of a heat exchanger core showing the serpentine split louver fins of the present invention sandwiched between heat exchanger core tubes.

FIGS. 9, 10 and 11 show the completed serpentine fin strips 12' integrated with tubes 30 to form heat exchanger core 50. As shown in FIG. 11, incoming air flowing in direction 35 enters core 50 at leading fin edge 31 and exits at trailing fin edge 33. The serpentine fin strips 12' are stacked in an alternating pattern with the tubes, and then compressed and brazed to form the completed core.

One particular advantage of the use of ribs with the split louver serpentine fin made by air forming is shown in FIG. 9 with respect to the location of the ends of the individual louvers 40 from adjacent tubes 30. It is desirable to ensure that there is sufficient distance $x_1$ and $x_2$ between the louver ends and the tubes, so that the fold is confined to the unformed area between louver rows, and the ends of the louvers are not distorted, closed or crushed, or the louver angle changed, by the folding process. The present invention of air forming a split louver serpentine fin has been shown to provide such distance to avoid damage to the louvers, and more importantly, provide a consistent distance $x_1$, $x_2$ between the louver ends and the tubes, preferably where $x_1$ is substantially equal to $x_2$, to permit the as-built heat exchanger to come closer to the theoretical performance of the design. The ribs formed within the split louver give the louver banks more integrity in the structure during the air forming of the convolutions as well as in the production of the radiator core when the tubes and fin strips are stacked and brazed.

Thus, the present invention provides an improved method for manufacturing split louvered serpentine fins using an air-forming process, which is cost-effective, yet produces a quality fin having consistently high efficiency and heat transfer rates.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of manufacturing serpentine fins for assembly between tubes in a heat exchanger core comprising:

providing a flat metal strip for making heat exchanger fins, the strip having a width between opposite strip edges and a length greater than the width;

forming in the strip, while the strip is substantially flat, multiple rows of split louvers, each row of split louvers comprising louvers having openings extending in the direction of the strip length and formed in a pair of adjacent, spaced louver banks extending across at least a portion of the width of the strip, and including ribs formed in the strip substantially parallel to the louver openings and extending across the pair of louver banks, the metal strip having unformed portions extending across the strip width between rows of strip louvers and ribs for forming folds across the width of the strip;

after forming the rows of split louvers, and while the strip is continually moving, applying an initial backpressure to the metal strip by contacting the strip at a first location to cause the substantially flat strip to buckle in the unformed portions and begin to form folds in the strip, with at least one row of split louvers between adjacent folds along the length of the strip; and thereafter applying further backpressure to the metal strip by contacting the strip at a second location downstream of the first location with respect to strip movement to complete formation of the folds of the strip to form the serpentine fin, the distance between the adjacent folds conforming to the desired spacing distance between the heat exchanger core tubes.

2. The method of claim 1 including forming the ribs adjacent the strip edges.

3. The method of claim 1 including forming the ribs in a center portion of the strip between the strip edges.

4. The method of claim 1 including forming the ribs adjacent the strip edges and in a center portion of the strip between the strip edges.

5. The method of claim 1 wherein the louvers have ends adjacent the unformed portions of the metal strip and wherein after applying the further backpressure to the metal strip, the distance between the louver ends and the folds at the unformed portions is substantially equal.

6. The method of claim 1 wherein the ribs are elongated, plastically deformed sections and include at least one angled leg connected to an adjacent louver.

7. The method of claim 1 wherein the metal strip has a thickness and the ribs have a height extending from a plane of the metal strip, and wherein the ratio of the height to the thickness of the metal strip is between about 4 and 5.

8. The method of claim 1 wherein the louvers are formed at an angle to a plane of the metal strip and the louver angle is between about 26 degrees and about 32 degrees.

9. A method of manufacturing serpentine fins for assembly between tubes in a heat exchanger core comprising:

providing a continually moving flat metal strip for making heat exchanger fins, the strip having a width between opposite strip edges and a length greater than the width;

forming in the strip, while the strip is substantially flat, multiple rows of split louvers, each row of split louvers comprising louvers having openings extending in the direction of the strip length and formed in a pair of adjacent, spaced louver banks extending across at least a portion of the width of the strip, and including ribs formed in the strip substantially parallel to the louver openings adjacent the strip edges and extending across the pair of louver banks, the metal strip having unformed portions extending across the strip width between rows of strip louvers and ribs for forming folds across the width of the strip;

after forming the rows of split louvers, applying a backpressure to the metal strip by contacting the strip at a first location to cause the substantially flat strip to buckle in the unformed portions and begin to form folds in the strip, with at least one row of split louvers between adjacent folds along the length of the strip; and thereafter applying a further backpressure to the metal strip to complete formation of the folds of the strip to form the serpentine fin by contacting the strip at a second location downstream of the first location with respect to strip movement, wherein the distance between the adjacent folds conforms to the desired spacing distance between the heat exchanger core tubes.

10. The method of claim 9 including forming the ribs in a center portion of the strip between the strip edges.

11. The method of claim 9 wherein the louvers have ends adjacent the unformed portions of the metal strip and wherein after applying the further backpressure to the metal strip, the distance between the louver ends and the folds at the unformed portions is substantially equal.

12. The method of claim 9 wherein the ribs are elongated, plastically deformed sections and include at least one angled leg connected to an adjacent louver.

13. The method of claim 9 wherein the metal strip has a thickness and the ribs have a height extending from a plane of the metal strip, and wherein the ratio of the height to the thickness of the metal strip is between about 4 and 5.

14. The method of claim 9 wherein the louvers are formed at an angle to a plane of the metal strip and the louver angle is between about 26 degrees and about 32 degrees.

15. A method of manufacturing serpentine fins for assembly between tubes in a heat exchanger core comprising:

providing a flat metal strip for making heat exchanger fins, the strip having a width between opposite strip edges and a length greater than the width;

forming in the strip, while the strip is substantially flat, multiple rows of split louvers, each row of split louvers comprising louvers having openings extending in the direction of the strip length and formed in a pair of adjacent, spaced louver banks extending across at least a portion of the width of the strip, and including ribs formed in the strip substantially parallel to the louver openings adjacent the strip edges and in a center portion of the strip between the strip edges and extending across the pair of louver banks, the metal strip having unformed portions extending across the strip width between rows of strip louvers and ribs for forming folds across the width of the strip and the louvers having ends adjacent the unformed portions of the metal strip;

after forming the rows of split louvers, and while the strip is continually moving, applying an initial backpressure to the metal strip by contacting the strip at a first location to cause the substantially flat strip to buckle in the unformed portions and begin to form folds in the strip, with at least one row of split louvers between adjacent folds along the length of the strip; and thereafter applying further backpressure to the metal strip by contacting the strip at a second location downstream of the first location with respect to strip movement to complete formation of the folds of the strip to form the serpentine fin, the distance between the adjacent folds conforming to the desired spacing distance between the heat exchanger core tubes wherein, after applying the further pressure to the metal strip, the distance between the louver ends and the folds at the unformed portions is substantially equal.

16. The method of claim 15 wherein the ribs are elongated, plastically deformed sections and include at least one angled leg connected to an adjacent louver.

17. The method of claim 15 wherein the metal strip has a thickness and the ribs have a height extending from a plane of the metal strip, and wherein the ratio of the height to the thickness of the metal strip is between about 4 and 5.

18. The method of claim 15 wherein the louvers are formed at an angle to a plane of the metal strip and the louver angle is between about 26 degrees and about 32 degrees.

* * * * *

UNITED STATES PATENT AND TRADEMARK OFFICE

CERTIFICATE OF CORRECTION

PATENT NO. : 7,866,042 B2
APPLICATION NO. : 11/622512
DATED : January 11, 2011
INVENTOR(S) : John A. Kolb It is certified that error appears in the above-identified patent and that said Letters Patent is hereby corrected as shown below:

Column 4, Line 19, delete “18a” and substitute therefore -- 18'a --.

Signed and Sealed this
Seventh Day of June, 2011

David J. Kappos

David J. Kappos
*Director of the United States Patent and Trademark Office*